United States Patent [19]

Itayama

[11] 4,102,596

[45] Jul. 25, 1978

[54] VENTILATING SUCTION AND EXHAUST FAN DEVICE OF SIROCCO TYPE

[75] Inventor: Shinichi Itayama, Osaka, Japan

[73] Assignee: Teizo Sakai, Osaka, Japan

[21] Appl. No.: 782,781

[22] Filed: Mar. 30, 1977

[30] Foreign Application Priority Data

Mar. 31, 1976 [JP] Japan ..... 51/36534

[51] Int. Cl.[2] ..... F01D 3/02

[52] U.S. Cl. ..... 415/101; 98/33 R; 415/98; 415/209; 415/198.1; 415/217; 415/219 C

[58] Field of Search ..... 415/198.1, 60, 68, 98, 415/99, 101, 184–186, 209, 210, 211, 206, 217, 218, 219 C; 60/39.43; 98/33 R

[56] References Cited

U.S. PATENT DOCUMENTS

| | | | |
|---|---|---|---|
| 574,619 | 1/1897 | Miller | 98/33 R |
| 1,229,274 | 6/1917 | Jack | 415/98 |
| 1,705,200 | 3/1929 | Morse | 415/219 C |
| 1,929,776 | 10/1933 | Faber | 98/33 R |
| 1,959,106 | 5/1934 | Messing | 415/101 |
| 2,152,614 | 3/1939 | Younger | 98/33 R |
| 2,206,858 | 7/1940 | McKee | 415/198.1 |

FOREIGN PATENT DOCUMENTS

| | | | |
|---|---|---|---|
| 2,208,713 | 8/1973 | Fed. Rep. of Germany | 415/198.1 |

*Primary Examiner*—C. J. Husar

[57] ABSTRACT

A ventilating suction and exhaust fan device of Sirocco type comprising a casing of cylindrical shape, a partition plate mounted within the casing and extending in a horizontal plane passing through a central axis of the casing and having a rectangular opening formed therein, a cylindrical impeller of Sirocco type rotatably mounted in said opening of the partition plate coaxially with respect to the casing, said impeller comprising a central vertical partition disc, a first cylindrical impeller section for exhaustion of air arranged on one side of the disc and a second cylindrical impeller section for suction of air arranged on the other side of the disc, first hood means for preventing the first impeller section from contacting the suction air, second hood means for preventing the second impeller section from contacting the exhaust air, and guide means for converting centrifugal flows generated by the impeller sections to axial flows.

6 Claims, 5 Drawing Figures

VENTILATING SUCTION AND EXHAUST FAN DEVICE OF SIROCCO TYPE

BACKGROUND OF THE INVENTION

This invention relates to a ventilating apparatus and more particularly, to a ventilating suction and exhaust fan device of Sirocco type in which when exhaustion and suction of enormous volumes of air are simultaneously carried out by means of a centrifugal fan, the flows of suction air and of exhaust air are both converted from centrifugal flows to axial flows and the possibility of mixing of the exhaust air and the suction air is completely eliminated.

Recently, many types of ventilators have come into use for ventilating rooms. However, these ventilators, which consist only of axial fans, are not satisfactory. Further, with these ventilators, air is sucked by reversing the direction of rotation of the fans, and this decreases the efficiency of the ventilators. Further, if only one such ventilator is used for ventilating a closed room in which offensive smell is continuously generated, the generated offensive smell is exhausted out of the room in the beginning; but, as time goes on, the air pressure in the room gradually decreases and, accordingly, the ventilator's efficiency of exhausting the offensive smell is also gradually reduced and at last the room is filled with the offensive smell and persons in the room have difficulty in breathing. Axial fans in which suction and exhaustion of air are simultaneously carried out are known. However, such fans have not been practically employed, since their efficiency is relatively low and they mix exhaust air with suction air.

In these circumstances, after many experiments and long investigation, the Applicant proposed a ventilating suction and exhaust fan device in which suction of air and exhaustion of air are simultaneously carried out by a fan of Plate type, thereby eliminating some of the disadvantages described above. However, this Plate type fan device has inherent disadvantages. One is that the size of the fan device is large relative to the volume of air to be handled by said fan device. Another is that the ventilating efficiency of said fan is relatively low, since a relatively large volume of exhaust air is mixed with suction air due to the fact that clearances between the circumference of the impeller and edges of the rectangular opening of the partition plate within which the impeller is mounted can not be completely sealed.

Subsequently, the Applicant proposed a fan device of Sirocco type comprising a rectangular casing, a cylindrical impeller rotatably mounted within the casing with its axis positioned perpendicular to the central axis of the casing, and two partition plates extending in a common horizontal plane passing through the central axis of the casing, the inner terminal edges of the plates being closely adjacent to the circumference of the impeller. The fan device of this construction is relatively compact, can be easily manufactured and can handle a relatively large volume of air, and the working efficiency of the fan device is improved by reducing mixing of the exhaust air and the suction air. However, in this known Sirocco type fan device, mixing of the exhaust air and the suction air is not completely eliminated, and therefore, the efficiency of the fan device is not satisfactory.

SUMMARY OF THE INVENTION

Accordingly, an object of the present invention is to provide a ventilating suction and exhaust fan device of Sirocco type which can effectively eliminate the drawbacks described above and which can completely prevent mixing of exhaust air and suction air, whereby the working efficiency of the fan device is significantly improved.

According to the present invention, there is provided a ventilating suction and exhaust fan device of Sirocco type which comprises a casing of cylindrical shape; a horizontal partition plate mounted within the casing and extending in a horizontal plane passing through a central axis of the casing and having a rectangular opening formed therein; a cylindrical impeller of Sirocco type rotatably mounted in said opening of the plate coaxially with respect to the casing, said impeller comprising a central vertical partition disc, a first cylindrical impeller section for exhaustion of air arranged on one side of the disc and a second cylindrical impeller section for suction of air arranged on the other side of the disc; a first semi-cylindrical hood arranged to surround the lower half of the first cylindrical impeller section, a second semi-cylindrical hood arranged to surround the upper half of the second cylindrical impeller section, side edges and inner end edges of said hoods being joined to edge portions of the opening of the partition plate and outer semi-cylindrical terminal edge portions of the hoods being in contact with an outer circumferential edge of the partition disc directly or through the medium of antifriction material such as nylon; and guide means for converting centrifugal flows generated by said impeller sections to axial flows, whereby exhaust air is completely separated from suction air, and therefore, the mixing of exhaust air and suction air is completely eliminated, as a result of which the working efficiency of the fan device is considerably improved.

The above and other objects and attendant advantages of the present invention will be more readily apparent to those skilled in the art from a reading of the accompanying drawings which show a preferred embodiment of the invention for illustration purpose only, but not for limiting the scope of the invention in any way.

DETAILED DESCRIPTION OF THE PREFERRED EMBODIMENT

Figure 2:
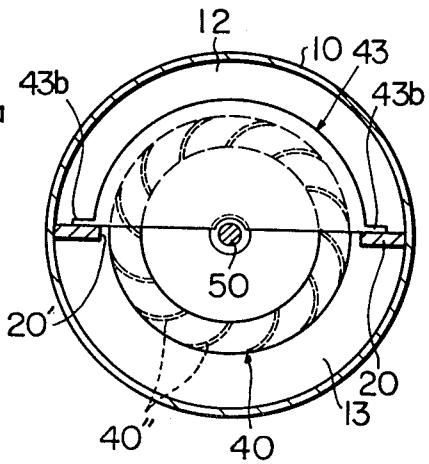
FIG. 2 is a cross-sectional view of the fan device as seen along the line X2 — X2 of FIG. 1.
Figure 1:
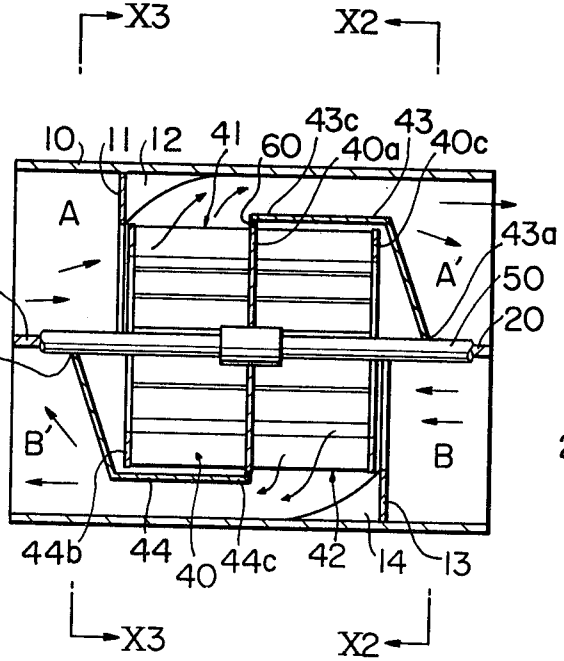
FIG. 1 is a longitudinal sectional view of a ventilating suction and exhaust fan device of Sirocco type according to the present invention.
Figure 3:
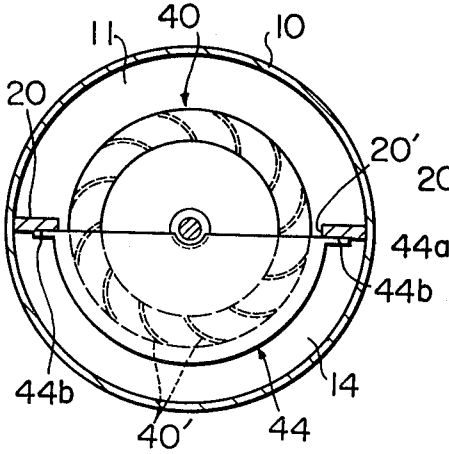
FIG. 3 is a cross-sectional view of the fan device as seen along the line X3 — X3 of FIG. 1.

In order to facilitate understanding of the present invention, the above known Sirocco type fan device having a rectangular casing (disclosed in the Japanese Patent Publication No. 12941/1976) is at first briefly described referring to FIGS. 4 and 5, and then the present invention will be described with reference to FIGS. 1 through 3.

Figure 4:
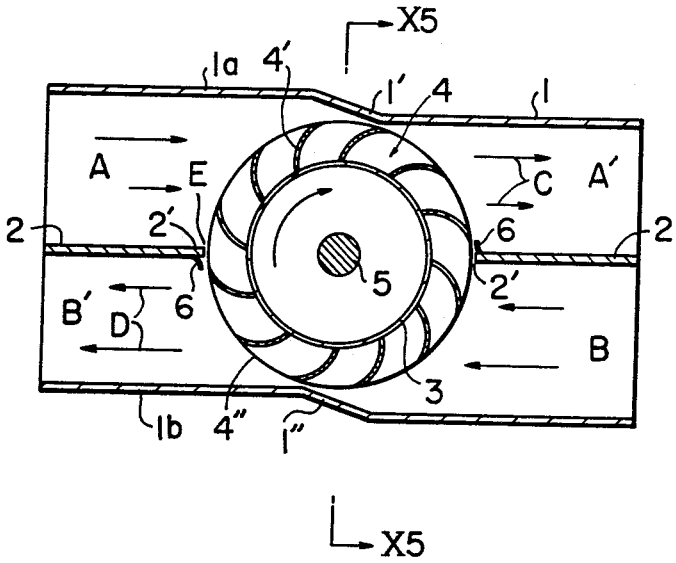
FIG. 4 (PRIOR ART)
FIG. 4 is a longitudinal sectional view of a known fan device of Sirocco type having a rectangular casing.
Figure 5:
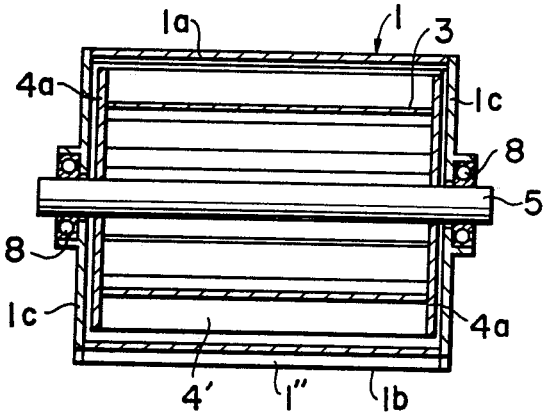
FIG. 5 (PRIOR ART)
FIG. 5 is a cross-sectional view of the known fan device as seen along the line X5 — X5 of FIG. 4.

Referring to FIGS. 4 and 5, the above known fan device of Sirocco type has a rectangular casing 1, and a cylindrical impeller 4 of Sirocco type which is rotatably mounted within the casing by rotatably supporting both ends of a shaft 5 of the impeller in the casing walls 1*c* through the medium of ball bearings 8 secured to said casing walls, the shaft 5 of the impeller being positioned perpendicular to a central axis of the casing in a horizontal plane, and the outer circumference 4'' of the impeller being adjacent to a top wall 1*a* and a bottom wall 1*b* of the casing. The impeller 4 comprises an inner circumferential sleeve 3 coaxial with the shaft 5, a plurality of fan blades 4' of Sirocco type extending outwardly from the sleeve 3 and spaced apart at equal distances along the circumference of the sleeve, and end plates 4*a*. Within the casing and forwardly and rearwardly of the impeller, longitudinal horizontal partition plate 2 is positioned substantially intermediate between the top and bottom casing walls 1*a* and 1*b*, the respective ends 2' (nearest to the impeller) of the partition plate 2 being adjacent to the outer circumference 4'' of the impeller 4. Thus, the casing 1 is divided into four chambers by the partition plates; i.e., as shown in FIG. 4, two upper exhaust chambers A, A' and two lower suction chambers B, B'. Further, the top and bottom walls 1*a*, 1*b* are provided with steps 1', 1'', respectively, immediately above and below the impeller shaft 5. In this known fan device, in order to prevent mixing of exhaust air (which flows from the chamber A to the chamber A', as shown by arrow C) and suction air (which flows from the chamber B to the chamber B', as shown by arrows D), the clearances E between the terminal ends 2' of the partition plates and the outer circumference 4'' of the impeller are reduced as much as possible, and further, partition members 6 made of low-friction material such as nylon sheet are mounted on the ends 2' of the partition plates in such a way that these members 6 frictionally engage with the circumference 4'' of the impeller.

However, in spite of these efforts, in said known fan device, such mixing could not be completely eliminated, and therefore, exhaust air and suction air were partially mixed.

The present invention eliminates such drawbacks completely. Referring to FIGS. 1 to 3, a ventilating suction and exhaust fan device of Sirocco type according to the present invention comprises a casing 10 of cylindrical shape within which a longitudinal horizontal partition plate 20 extending in a horizontal plane passing through an axis of the casing is mixedly mounted. The partition plate 20 has a rectangular opening 20' formed therein symmetrically with respect to the axis of the casing. A cylindrical impeller 40 is rotatably mounted within the opening 20' and is positioned coaxially with the casing. The impeller 40 comprises a central shaft 50, and a central vertical partition disc 40*a* which is fixedly mounted on the shaft and from both sides of which a plurality of Sirocco fan blades 40' and 40'' protrude in axial direction, respectively. These fan blades 40', 40'' are reinforced by end ring plates 40*b* and 40*c*, respectively. Thus, the impeller 40 is divided into two cylindrical impeller sections 41 and 42 which are constituted by the partition disc 40*a*, the blades 40', the end ring 40*b*; and the disc 40*a*, the blades 40'', the end ring 40*c*, respectively. Adjacent to the ring plate 40*b* an upper semi-circular ring wall 11 having an inner diameter equal to or slightly smaller than an outer diameter of the end ring 40*b* is mounted on the inner wall of the casing. Similarly, adjacent to the ring plate 40*c* a lower semi-circular ring wall 13 having an inner diameter equal to or slightly smaller than an outer diameter of the ring 40*c* is also mounted on the inner wall of the casing. These ring walls 11, 13 have guides 12, 14 including spherical inner guide surfaces for converting centrifugal flows generated by the respective impeller sections 41, 42 to axial flows. Further, an upper semi-cylindrical hood 43 surrounds a semi-cylindrical upper half of the impeller section 42 and similarly a lower semi-cylindrical hood 44 surrounds a semi-cylindrical lower half of the impeller section 41. Inner edges 43*a*, 43*b* and 44*a*, 44*b* of the hoods 43, 44 are joined to transverse edges and longitudinal edges of the rectangular opening 20' of the partition plate 20. Outer terminal semi-circular edges 43*c*, 44*c* of the hoods 43, 44 are always in slight contact with the outer circumferential edge of the central partition disc 40*a* of the impeller 40 directly or through the medium of antifriction material 60 such as nylon. Thus, the casing 10 is divided into two completely separated passages (the upper one being for exhaust air and the lower one being for suction air) by the horizontal partition plate 20, the vertical partition disc 40*a* and the hoods 43, 44, thereby completely preventing the mixing of exhaust air and suction air. Further, according to the construction of the fan device of the present invention, the suction efficiency and the exhaust efficiency of the fan device are significantly increased, since all of the fan blades 40' of the cylindrical impeller section 41 can be used for exhaustion of air and all of the fan blades 40'' of the cylindrical impeller section 42 can be used for suction of air. (It should be noted that, on the contrary, in the prior art Sirocco type fan, only the blades of the upper half of the impeller are used for exhaustion and only the blades of the lower half of the impeller are used for suction.)

The operation of the fan device according to the present invention is as follows. Air to be exhausted is conveyed from a room to be ventilated (not shown) to a chamber A, from which the air is exhausted by the impeller section 41 and discharged as centrifugal flow. This centrifugal flow is converted to axial flow by the guide 12 and is sent to a chamber A' and then discharged to atmosphere. Similarly, fresh air from atmosphere is conveyed to a chamber B, from which the air is sucked by the impeller section 42 and released as centrifugal flow. This centrifugal flow is also converted to axial flow by the guide 14 and is sent to the room through a chamber B'. During the operation of the fan, the air to be exhausted is completely separated from the air to be drawn by way of the partition plate 20, the central partition disc 40*a* and the hoods 43 and 44, and therefore, mixing of exhaust air and suction air is completely eliminated, thereby obtaining high working efficiency of the fan. The efficiency of the fan of the present invention is further increased by the fact that both exhaustion and suction are carried out by the whole cylindrical impeller sections 42, 41, respectively.

While the preferred embodiment of the invention has been shown and described in detail, it will be understood that it is for illustration only and is not to be taken as a definition of the invention, reference being had for this purpose to the appended claims.

What is claimed is:

1. A ventilating suction and exhaust fan device of Sirocco type, characterized in that it comprises a casing of cylindrical shape; a partition plate mounted within the casing and extending in a horizontal plane passing through a central axis of the casing and having a rectangular opening formed therein; a cylindrical impeller of Sirocco type rotatably mounted in said opening of the partition plate coaxially with respect to the cylindrical casing, said impeller comprising a central vertical partition disc, a first cylindrical impeller section for exhaustion of air arranged on one side of the disc and a second cylindrical impeller section for suction of air arranged on the other side of the disc; first hood means for preventing the first impeller section from contacting the suction air; and second hood means for preventing the second impeller section from contacting the exhaust air.

2. The fan device as set forth in claim 1, characterized in that said first hood means comprises a semi-cylindrical hood arranged to surround a lower or an upper half of the first cylindrical impeller section and said second hood means comprises a semi-cylindrical hood arranged to surround an upper or a lower half of the second cylindrical impeller section, side edges and inner end edges of the hoods being joined to edge portions of the opening of the parition plate, outer semi-cylindrical terminal edge portions of the hoods being always in contact with an outer circumferential edge of the partition disc of the impeller.

3. The fan device as set forth in claim 1, characterized in that it further comprises guide means for converting centrifugal flows generated by said impeller sections to axial flows.

4. The fan device as set forth in claim 2, characterized in that it further comprises guide means for converting centrifugal flows generated by said impeller sections to axial flows.

5. The fan device as set forth in claim 2, characterized in that said outer semi-cylindrical terminal edge portions of the hoods are always in contact with said outer circumferential edge of the partition disc through the medium of antifriction material arranged on said circumferential edge of the disc or on said terminal edge portions of the hoods.

6. The fan device as set forth in claim 4, characterized in that said outer semi-cylindrical terminal edge portions of the hoods are always in contact with said outer circumferential edge of the partition disc through the medium of antifriction material arranged on said circumferential edge of the disc or on said terminal edge portions of the hoods.

* * * * *